US006517186B1

(12) United States Patent
Wolf et al.

(10) Patent No.: US 6,517,186 B1
(45) **Date of Patent: *Feb. 11, 2003**

(54) TRANSACTION PRINTING DEVICE HAVING WIPER DEBRIS COLLECTORS

(75) Inventors: Frederick Andrew Wolf, Boise, ID (US); Yinan Xu, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/912,746

(22) Filed: Jul. 24, 2001

Related U.S. Application Data

(62) Division of application No. 09/472,716, filed on Dec. 23, 1999.

(51) Int. Cl.[7] ..... B41J 2/165
(52) U.S. Cl. ..... 347/33
(58) Field of Search ..... 347/33, 32

(56) References Cited

U.S. PATENT DOCUMENTS

| | | | | |
|---|---|---|---|---|
| 4,709,247 A | | 11/1987 | Piatt et al. | 347/40 |
| 5,025,271 A | | 6/1991 | Baker et al. | 347/87 |
| 5,202,702 A | | 4/1993 | Terasawa et al. | 347/32 |
| 5,774,140 A | * | 6/1998 | English | 347/33 |
| 5,815,177 A | | 9/1998 | Sasaki | 347/44 |
| 5,905,513 A | | 5/1999 | Brandon et al. | 347/33 |
| 6,302,515 B2 | * | 10/2001 | Wolf et al. | 347/33 |
| 6,367,904 B1 | * | 4/2002 | Xu et al. | 347/33 |

FOREIGN PATENT DOCUMENTS

| | | | | |
|---|---|---|---|---|
| EP | 829 359 | | 3/1998 | |
| EP | 798 122 | | 5/2001 | |
| JP | 404037555 A | * | 2/1992 | 347/33 |
| JP | 5169671 | | 9/1993 | |

* cited by examiner

*Primary Examiner*—Anh T. N. Vo
(74) *Attorney, Agent, or Firm*—Jerry R. Potts

(57) ABSTRACT

A transaction printing device includes a printhead cartridge having an integrally formed wiper cleaning station and printhead. The wiper cleaning station is positioned so as to engage a wiper as the cleaning station travels and includes a pair of recessed wiper debris collectors. Each of the debris collectors opens into a corresponding debris accumulation channel to facilitate accumulating removed wiper debris with the debris collectors.

13 Claims, 5 Drawing Sheets

TRANSACTION PRINTING DEVICE HAVING WIPER DEBRIS COLLECTORS

RELATED APPLICATIONS

This is a divisional of copending application Ser. No. 09/472,716 filed on Dec. 23, 1999 which is hereby incorporated by reference herein.

This application is related to co-pending patent application Serial No.: 09/471,860 by Yinan Xu, entitled "Wiper Cleaning Apparatus and Method of Using Same" filed Dec. 23, 1999, and co-pending patent application Ser. No.: 09/471,436 by Yinan Xu et al., entitled "Transaction Printing Device and Method of Using Same," filed Dec. 23, 1999.

TECHNICAL FIELD

The present invention relates to an inkjet printing system and method of printing. More particularly, the present invention relates to an inkjet transaction printing device and a method of printing transaction receipts with a disposable printhead and wiper debris collector.

BACKGROUND

A typical inkjet printing device generally include a traveling carriage unit for supporting one or more printheads in a desired orientation relative to a ink receiving surface. In this regard, as the carriage unit travels along a rectilinear path of travel adjacent to the ink-receiving surface, the printheads eject ink on to the ink-receiving surface to form desired indicia.

Such printheads typically have an orifice plate with a plurality of small nozzles for ejecting the ink toward the ink-receiving surface. Because of residue build up on and around these small nozzles or opening, many inkjet printing devices include a service station module that caps, wipes and catches spit ink droplets that facilitates keeping the printhead clean. A necessary operation in servicing such a printhead is to make certain that the wiper utilized to remove residue is also cleaned periodically.

A prior solution for cleaning such a wiper included providing a wiper cleaning station within the service station module. In this regard, not only is a wiper cleaning station required but also special wiper cleaning fluids are necessary to clean the wiper. Thus, while such wiper cleaning stations are satisfactory for their intended purpose, the wiper cleaning station parts are nevertheless expected to last for the life of the printing device and adds to the cost of operating the printer because of the special cleaning fluids that must be provided. Therefore it would be highly desirable to have a new and improved inkjet printing device that does not require a wiper cleaning station that is expected to last the life of the printing device nor require special cleaning fluids.

SUMMARY OF THE INVENTION

The present invention provides a disposable printhead cartridge having an integrated inkjet printhead and wiper debris collector for printing and servicing a transaction printing device.

BRIEF DESCRIPTION OF DRAWINGS

The above mentioned features of this invention and the manner of attaining them will become apparent, and the invention itself will be best understood by reference to the following description of the embodiment of the invention in conjunction with the accompanying drawings, wherein.

DETAILED DESCRIPTION OF THE PREFERRED EMBODIMENT

Figure 1:
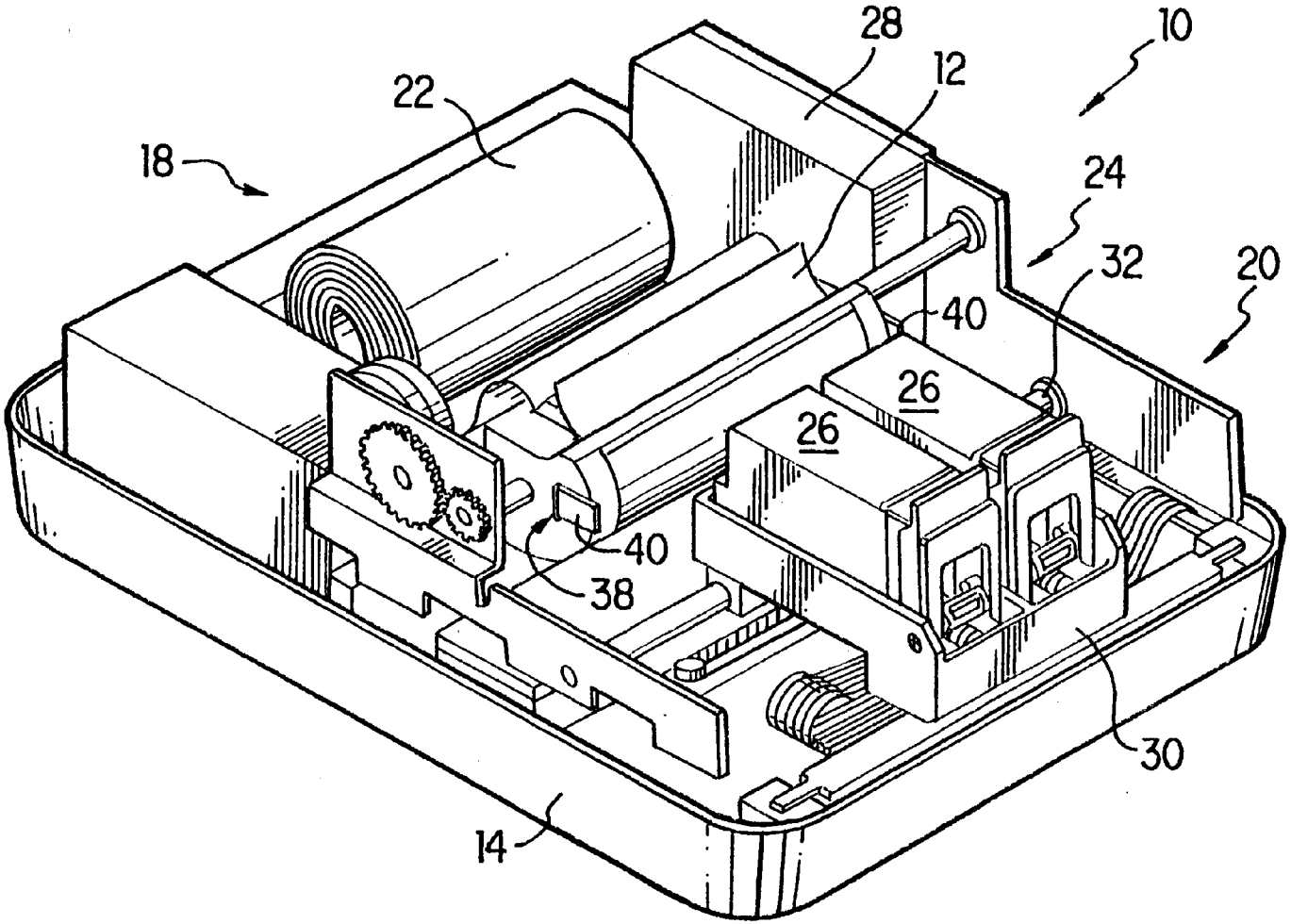
FIG. 1 is a perspective view of an inkjet printing device which uses an exemplary disposable inkjet print cartridge with an integrated printhead and printhead wiper cleaning station which is constructed in accordance with the present invention.

Referring now to the drawings and more particularly to FIG. 1 thereof there is illustrated an inkjet printing device, such as a transaction printer 10 that is constructed in accordance to the present invention. The transaction printer 10 is utilized for printing receipts and the like in typical commercial transactions. In this regard, the transaction printer 10 is constructed for ease of use in a highly reliable manner requiring operator intervention only for the purpose of changing the consumables utilized in printing transaction receipts, such as a transaction receipt 12 illustrated in FIG. 1.

Considering now the transaction printer 10 in greater detail with reference to FIG. 1, the printer 10 generally includes a base 14 for supporting therein a paper delivery system 18 and an ink delivery system 20. The paper delivery system 18 moves a continuous roll of paper 22 through a print zone 24, where ink is ejected onto the paper 22 from one or more disposable low profile inkjet printhead cartridges, such as a printhead cartridge 26 that forms part of the ink delivery system 20.

As best seen in FIG. 1, the ink delivery system 20 includes a print engine 28 for controlling the movement of a carriage cartridge stall 30 that travels along a slide bar 32 in a rectilinear path of travel adjacent to the print zone 24. The print engine 28 also controls the ejecting of ink from the cartridge 26 to facilitate the forming of transaction receipts. As the manner of controlling the movement of the carriage cartridge stall 30 and the manner of ejecting of ink from the cartridge 26 are well known to those skilled in the art of inkjet printing, the details of the print engine 28 will not be described hereinafter in greater detail. In a like manner, the paper delivery system 18 for moving the continuous roll of paper 22 through the print zone 24 is also well known to those skilled in the art of impact printers and thus, the paper delivery system 18 will not be described in greater detail. It should be noted that the cartridge stall 30 may accommodate either a single cartridge 26 for black ink printing or a pair of cartridges 26 for black and selected color printing.

Figure 2:
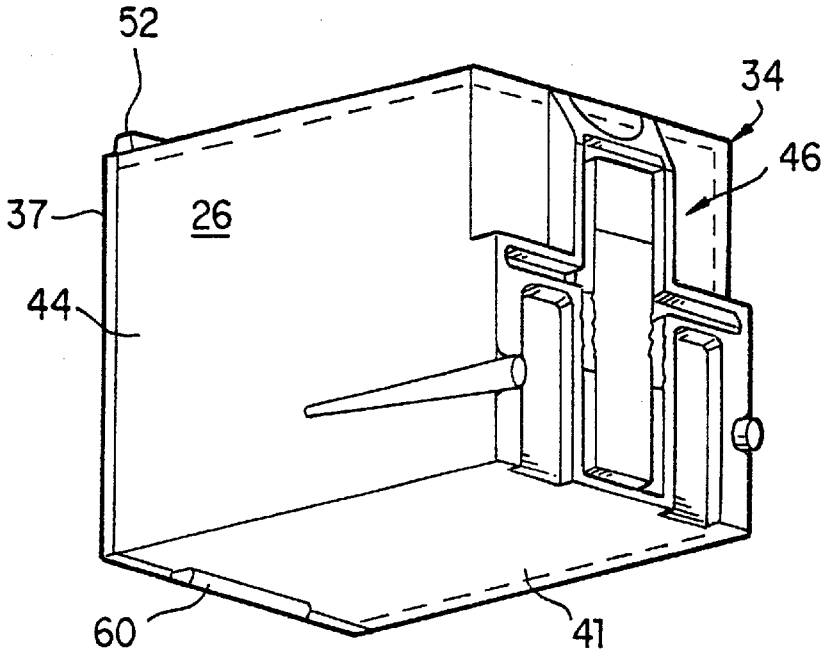
FIG. 2 is an exemplary disposable print cartridge having an integrated inkjet printhead and printhead wiper station which may be used in the printing device of FIG. 1.

Considering now the inkjet printhead cartridge 26 in greater detail with reference to FIG. 2, the inkjet printhead cartridge 26 generally includes a cartridge body 34 having a substantially hollow structure for holding a supply of ink. In this regard, supply of ink provided in the cartridge 26 is a fast drying pigment ink that is provided in either black or a user selected color, such as magenta, cyan or yellow for example.

As best seen in FIG. 2, the cartridge body 34 has a general box like structure that includes a rear wall 37, a top wall 39, a bottom wall 41, a pair of side walls 43 and 44 respectively and a front wall 46. Integrally formed to the front wall 46 and projecting outwardly therefrom is a front face portion 36 having a sloping top wall 71 terminating at a lower lip 65. A lower portion of the front face portion 36 helps define an inkjet printhead wiper cleaning station 45 as will be described hereinafter in greater detail. An inkjet printhead 47 is mounted within a recessed channel area 42 on the front face portion 36 and is sandwiched between the wiper cleaning station 45.

In order to help improve the reliable operation of the printhead 47, the printing device 10 also includes a wiper assembly 38 and wiper 40. The wiper assembly 38 is mounted to the paper delivery system 18 in such a manner to provide interference between the wiper 40 and the printhead cartridge 26. In this regard the interference is also provided with the printhead 47 in order to remove any residue build up on and around a set of fine-dimensioned orifices 58 (FIG. 7) forming thereon. In this regard, the interference of the wiper 40 with the printhead 47 is set to about between 0.25 millimeters to about 0.75 millimeters. A more preferred setting is between about 0.35 millimeters to about 0.60 millimeters, while the most preferred setting is set to about 0.50 millimeters. The wiper cleaning station 45 defined by the front face portion 36 of the printhead cartridge 26 makes certain that the wiper 40 is cleaned of accumulated debris each time the wiper 40 and the printhead 47 move relative to one another.

The ink delivery system 20 further includes a sponge 48 that is carried within a chamber 50 defined by the hollow space within the interior of the cartridge body 34. The sponge 48 is for holding the supply of ink within the interior of the cartridge body 34. A standpipe (not shown) conveys the printing fluid from the chamber 50 to the printhead 47.

Figure 7:
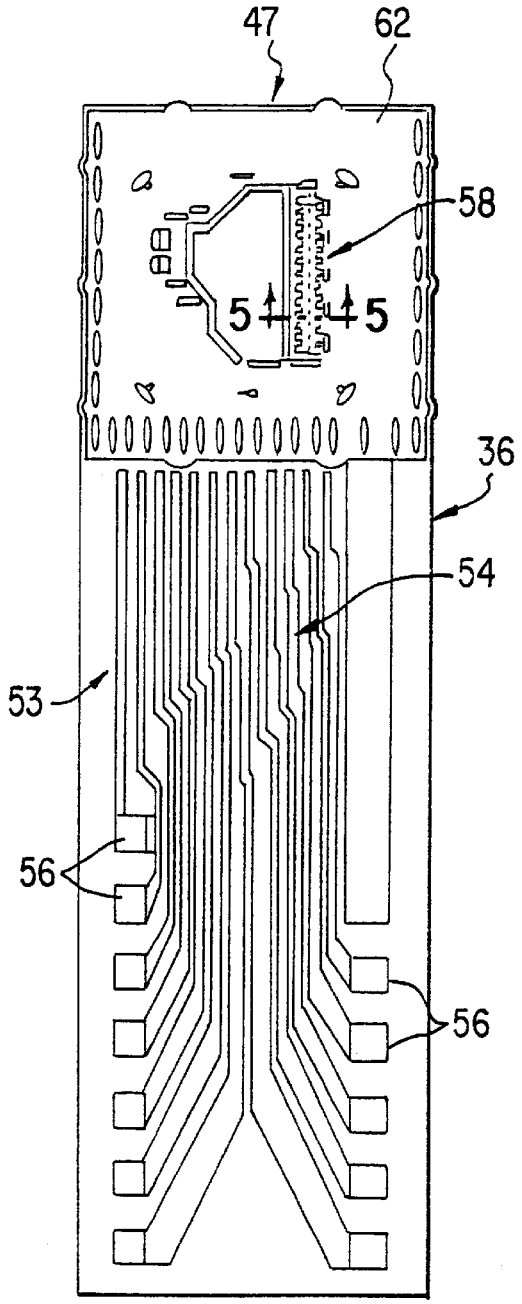
FIG. 7 is a greatly enlarge front face plan view of a printhead of the print cartridge of FIG. 2.

Considering now the printhead 47 in greater detail with reference to FIG.7, the printhead 47 generally includes a printed circuit 53 which electrically couples the printhead 47 via a set of circuit traces 54 and electrical contacts 56 with the print engine 28. That is, the electrical contacts 56 individually make electrical contact with matching contacts on a flex circuit (not shown) to the carriage stall 30, and provide for the electrical interface of the printhead 47 with the print engine 28. Individual fine-dimension orifices, such as the orifices 58 of the printhead 47 eject fluid when appropriate control signals are applied to the contacts 56 by the print engine 28. The fine-dimensioned orifices 58 are formed in a metallic plate member 62 that is adhesively attached to the floor of the recess area 42 of the underlying front face portion 36 of the printhead cartridge 26.

In order to provide a fluid communication path between the chamber 50 and a fluid receiving cavity 64 formed in the front face portion 36 of the cartridge body 34, a through hole 66 is formed between front face portion 36 and a portion of the plate member 62.

Considering now the printhead cartridge 26 in greater detail, the printhead cartridge 26 generally includes an integrally form outwardly projecting tab 35 for facilitating the installation and removal of the printhead cartridge 26 from the carriage stall 30. The tab 35 is disposed on the rear wall 37 of the cartridge body 34 adjacent to the top 39 of the cartridge body 34.

A top bull feed lip 52 is integrally formed in the top wall 39 extends across substantially the entire width dimension W of the cartridge body 34 adjacent to the rear wall 37. A bottom bull feed lip 60 is disposed adjacent the bottom of the rear wall 37 on the bottom wall 41 of the cartridge body 34. The bottom bull feed lip 60 is about one half the width dimension of the top bull feed lip 52. In this regard, the top bull feed lip 52 and the bottom bull feed lip 60 cooperate with a bull feeder (not shown) to facilitate the proper orientation of the cartridge body 34 for manufacturing assembly purposes.

The cartridge body 34 has integrally formed thereon a right side datum member 93 and left side datum member 95. The datum members 93 and 95 are integrally formed on respective ones of the sides 43 and 44. In this regard, the respective datum members 93 and 95 extend across substantially the entire longitudinal dimension D of the walls 43 and 44 respectively. The datum members 93 and 95 are provided on the cartridge body 34 to further help facilitate the manufacturing of the printhead cartridge 26 b y cooperating with the bull feeder to provide proper orientation of the cartridge body 34 for assembly purposes.

The datum members 93 and 95 also help in the proper installation of the printhead cartridge 26 in the carriage stall 30. In this regard, as best seen in FIG. 2, the datum members 93 and 95 each extend outwardly from the front face portion 36 of the cartridge 26 to space the front face portion 36 from the cartridge stall 30 when the cartridge 26 is installed in the stall 30. This spacing distance is selected to help provide a proper spacing between the orifices 58 and the paper 22 for printing purposes.

Figure 4:
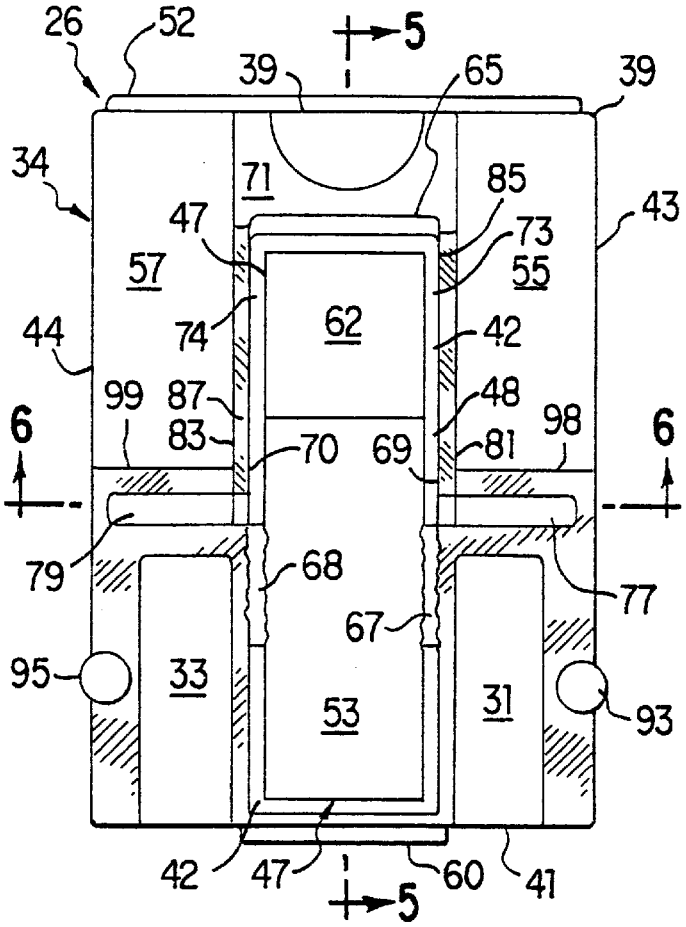
FIG. 4 is a front face plan-view of the print cartridge of FIG. 2.
Figure 5:
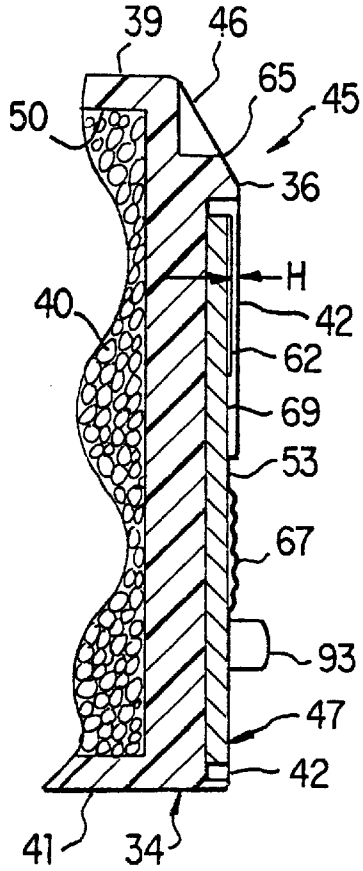
FIG. 5 is an enlarged diagrammatic fragmentary cross sectional view taken at the line 5—5 of FIG. 4.
Figure 6:
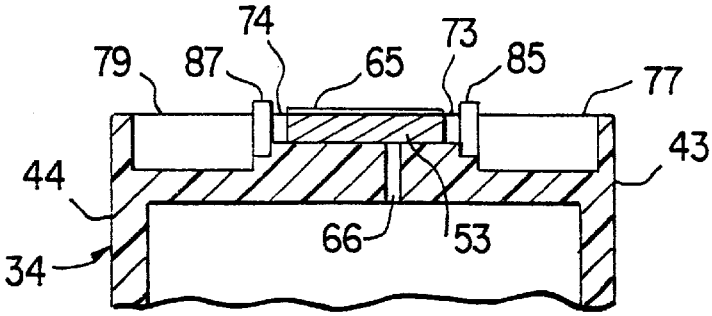
FIG. 6 is an enlarged diagrammatic fragmentary cross sectional view taken at the line 6—6 of FIG. 4.

Considering now the front face portion 36 in greater detail with reference to FIGS. 4–6, the front face portion 36 includes a pair of spaced apart flex clip clearing slots 31 and 33 respectively. The slots 31 and 33 have a generally rectangular shaped and are disposed on opposite sides of the printhead 47 adjacent the glass substrate 73. The flex clip clearing slots 31 and 33 permit the printhead cartridge 26 to rest in the carriage stall 30 without interfering with the flex cable clips (not shown) disposed therein.

As best seen in FIG. 4, the elongated recess area 42 has a sufficient depth and width for receiving therein the printhead 47. In this regard, when the printhead 47 is mounted within the recess 42, the printhead 47 cooperates with a right sidewall 69 and a left sidewall 70 of the recess 42 to form a pair of debris accumulation channels 73 and 74 respectively. The channels 73 and 74 extend into a pair of recessed wiper debris catchers or collectors 77 and 79 respectively each having a generally rectangular box like shape. The debris catchers 77 and 79 are closed on one end and open into respective channels 73 and 74 to permit debris flowing and falling down the channels under the force of gravity to accumulate within the catchers 77 and 79. A pair of dams 67 and 68 block the respective channels 73 and 74 for helping to direct channel residual ink into the catchers 77 and 79.

The front face portion 36 further includes a pair of spaced sidewall members 81 and 83 that extend perpendicularly outwardly from the front wall 46. The side wall members terminate in a pair of lips 85 and 87 respectively that are disposed adjacent to the recess 42. In this regard, the lips are disposed in a horizontal plane parallel to the printhead 47 but at a slightly higher elevation for facilitating the cleaning of the wiper 40 as it first engages a side wall member, such as the side wall member 81 and then a lip, such as the lip 87. As best seen in FIG. 2, the respective ones of the lips 85 and 87 have a sufficient width to provide a cleaning surface for engaging the cleaning surfaces of the wiper 40.

Considering now the operation of the wiper cleaning station 45 in greater detail with reference to FIGS. 1–2, as the printhead cartridge 26 and wiper 40 are moved relative to one another in a first direction, the printhead cartridge 26 will engage a first cleaning surface of the wiper 40 with side wall 81. As relative movement continues in this same first direction, the first cleaning surface of the wiper 40 is scraped along a second cleaning surface provided by the lip surface 87. This scraping action permits any debris on the first cleaning surface of the wiper 40 to fall and flow down the sidewall 81 onto a lower right side plateau 98. From the lip surface 87, the wiper 40 snaps into the channel 73 permitting any remaining wiper debris to fall freely down the channel 73 and into the debris accumulating catcher 77.

Next, the wiper 40 travels across the orifices 58 of the printhead 47 to clean the orifices 58 with the cleaned wiping surface of the wiper 40. After cleaning the orifices 58, the wiper 40 snaps off of the printhead 47 entering the opposite channel 74 permitting any debris removed from the printhead 47 to fall freely down the channel 74 to be accumulated in the channel 74 and the debris accumulating catcher 79. As relative movement continues in the first direction, the first cleaning surface of the wiper engages the wall 70 and then the lip surface 85. This engagement and scraping action further cleans the first cleaning surface of the wiper allowing the debris to fall down the wall 70, and the channel 74 for accumulation in the debris accumulating catcher 79. After passing over the lip surface 85, the wiper 40 snaps into the space opposite side wall 83 allowing any remaining debris to fall under the force of gravity onto the outside lower left plateau 99.

Considering further the operation of the cleaning station 45 with reference to FIGS. 1–2, as the printhead cartridge 26 and wiper 40 are moved relative to one another in a second or opposite direction than the first direction, the printhead cartridge 26 will engage a second cleaning surface of the wiper 40 with side wall 83. As relative movement continues in this same second direction, the second cleaning surface of the wiper 40 is scraped along a second cleaning surface provided by the lip surface 87. This scraping action permits any debris on the second cleaning surface of the wiper 40 to fall and flow down the sidewall 83 onto the lower plateau 99. From the lip surface 87, the wiper 40 snaps into the channel 74 permitting any remaining wiper debris to fall freely down the channel 74 and into the debris accumulating catcher 79.

Next, the wiper 40 travels across the orifices 58 of the printhead 47 to clean the orifices 58 with the cleaned second wiping surface of the wiper 40. After cleaning the orifices 58, the wiper 40 snaps off of the printhead 47 entering the opposite channel 73 permitting any debris removed from the printhead 47 to fall freely down the channel 73 to be accumulated in the channel 73 and the debris accumulating catcher 77. As relative movement continues in the first direction, the first cleaning surface of the wiper engages the wall 69 and then the lip surface 87. This engagement and scraping action further cleans the second cleaning surface of the wiper 40 allowing the debris to fall down the wall 69, and the channel 73 for accumulation in the debris accumulating catcher 77. After passing over the lip surface 87, the wiper 40 snaps into the space opposite side wall 81 allowing any remaining debris to fall under the force of gravity onto the outside plateau 98.

The above described cleaning action of the first cleaning surface of the wiper 40 and the second cleaning surface of the wiper 40 is repeated until the ink supply of the printhead cartridge 26 is spent. At this time the printhead cartridge 26 is replaced resulting in a new wiper station being provided. It should also be appreciated by those skilled in the art that the cutout areas indicated generally at 55 and 57 on either side of the raised front face portion above plateaus 98 and 99 respectively allows the wiper to disengage from the printhead, which in-turn allow the linear translation of the printhead cartridge to be reversed without creating any substantial wiper wear. The cutout areas 55 and 57 also allow a centrally disposed service station to be placed in the printing device 10 thereby greatly reducing the overall width of the printing device 10.

Considering now the manufacture of the fully integrated thermal (FIT) fluid jet architecture of the printhead 47 in greater detail with reference to FIGS. 7–10, the thermal inkjet printhead 47 includes a substrate 72 (FIGS. 9–10), which is most preferably formed as a plate of glass (i.e. an amorphous, generally non-conductive material). As seen in plan-view, the substrate 72 has a generally rectangular shape. Most preferably, the glass substrate is formed from an inexpensive type of soda/lime glass utilized in ordinary glass windows, which makes the printhead 47 very economical to manufacture. The printhead 47 is especially economical and inexpensive to manufacture when considered in comparison to printheads utilizing the conventional technologies that require a substrate of silicon or other crystalline semiconductor material.

Figure 8:
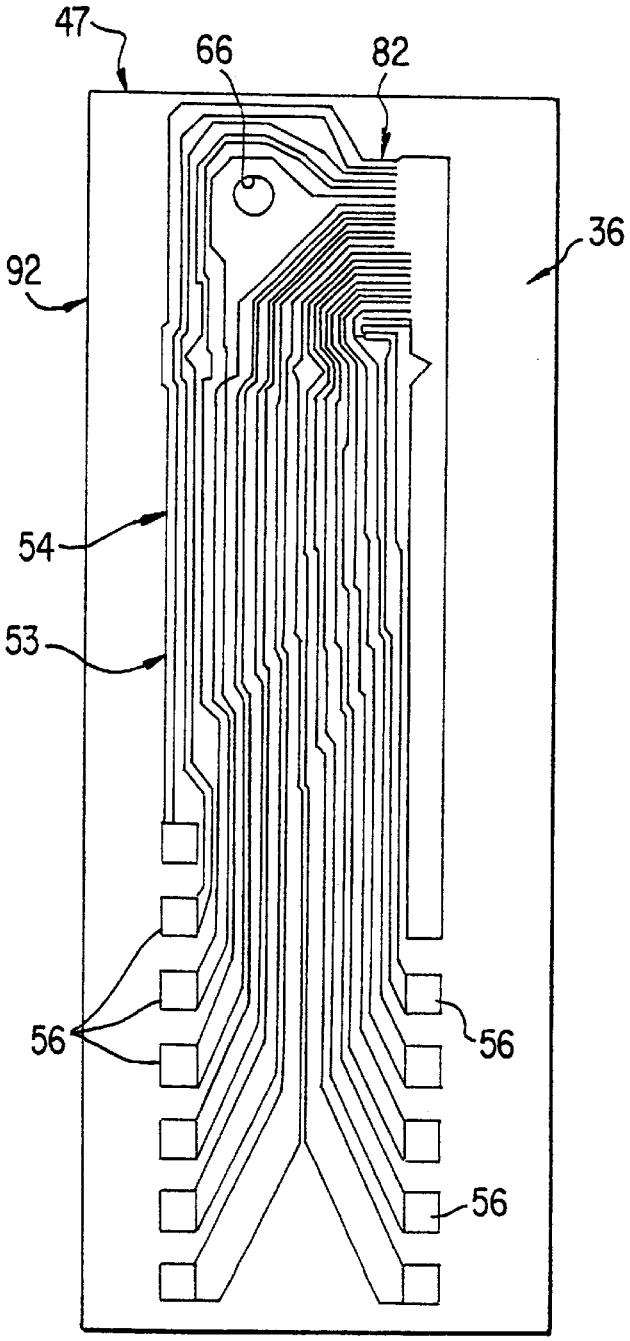
FIG. 8 is a greatly enlarged front face plan view similar to FIG. 7 of the printhead with portions removed for clarity of illustration.

On the glass substrate 72 is formed a thin-film structure 75 of plural layers. As will be further explained, during manufacturing of the printhead head 47, the thin-film structure 75 is formed substantially of plural thin-film layers applied one after the other and atop of one another, and each of which entirely covers and is congruent with the plan-view shape of the substrate 72. Again, this plan-view shape of the substrate 72 is seen in FIGS. 7 and 8. Once selected ones of these thin-film layers are formed on the substrate 72, subsequent patterning and etching operations are used to define the contacts 56 and printed circuit 53, for example, as is described hereinafter in greater detail.

The thin-film structure 75 includes a metallic heat sink and diffusion barrier thin-film layer 76 (FIGS. 5 and 6) which is applied upon the substrate 72. The layer 76 covers the entire plan-view shape of the substrate 72, and is preferably formed of chrome about 1 to 2 microns thick. Alternatively, the layer 76 may be formed of other metals and alloys. For example, the thin-film heat sink and diffusion barrier layer 76 may be formed of gold, palladium, or platinum, or of alloys of these or other metals.

Upon the metallic thin-film layer 76 is formed an insulator thin-film layer 78. The insulator layer 78 is preferably formed of silicon oxide, and is about 1 to 2 microns thick. Again, this insulator layer 78 covers and is congruent with the entire plan-view shape of the substrate 72.

Next, on the substrate 72 and on the insulator layer 76, is formed a resistor thin-film layer 80. The thin-film resistor layer 80 is preferably formed of tantalum, aluminum allow, and is preferably about 600 Angstroms thick. The resistor thin-film layer 80 is formed to cover and be congruent with the entire plan-view shape of the substrate 72, but does not remain this extensive. That is, the resistor thin-film layer 80 is later patterned and etched back until it covers only an area congruent with the traces 54 of the printed circuit 53, with each of the contacts 56, and with each one of plural print resistor areas 82 (FIG. 9, and generally indicated with the arrowed number 82 on FIG. 8).

Over the unpatterned and unetched resistor layer 80 is next formed a metallic conductor thin-film layer 84. The metallic conductor thin-film layer 84 is formed preferably of aluminum, and is about 0.5 microns thick. Again, this metallic conductor layer 84 is initially formed to cover and be congruent with the entire plan-view shape of the substrate 72. However, the conductor layer 84 is also later patterned and etched back to cover only the area defining the traces 54 of the printed circuit 53, and defining the contacts 56. More particularly, the conductor layer 84 is first etched away at the location of the print resistors 82 so that a portion of the thin film resistor layer 60 spanning between traces 54 of the printed circuit 53 provides the only conduction path between these traces 54. Later, the etching operation is carried further, removing both the conductive layer 64 and the underlying resistive layer 60 over the entire plan-view shape of the substrate 72, except at the locations of the traces 54 and contact pads 56. This etching operation leaves the traces 54 and the contact pads 56 standing in relief on the insulative layer 78, as can be appreciated from viewing FIG. 9.

Accordingly, an in view of the foregoing, it will be understood that during operation of the printhead 47 when a current is applied between two of the contacts 56 leading via traces 54 to opposite sides of one of the print resistors 62, the current to and from the respective print resort 82 is carried in the traces of the printed circuit 53 by a combination of the conductor thin-film layer 84 and the underlying resistor thin-film layer 80. Because the conductive layer 64 has a much lower resistance than the resistive layer 80, most of this current will flow in the layer 84. However, at the print resistor 82 itself, only the underlying resistor layer 80 is available to carry (the overlying conductive layer 64 having been locally etched away). The print resistors 82 are fine-dimension areas of the resistive layer 80. Thus, the print resistors 82 can be caused to quickly dissipate energy, and to liberate beat. However, also as best seen in FIG. 7, and recalling that the metallic heat sink layer 76 cover substantially the entire plan-view shape of the substrate 72, it will be understood that this heat sink layer 76 both underlies the resistors 82 to absorb heat from these resistors, and has a large area (i.e. essentially the entire plan-view area of the printhead 47) from which to dissipate excess heat. Thus, the printhead 47 during operation maintains a desirably low temperature, and can operate at firing repetition rates not hereto possible with conventional printheads using a glass substrate.

Figure 9:
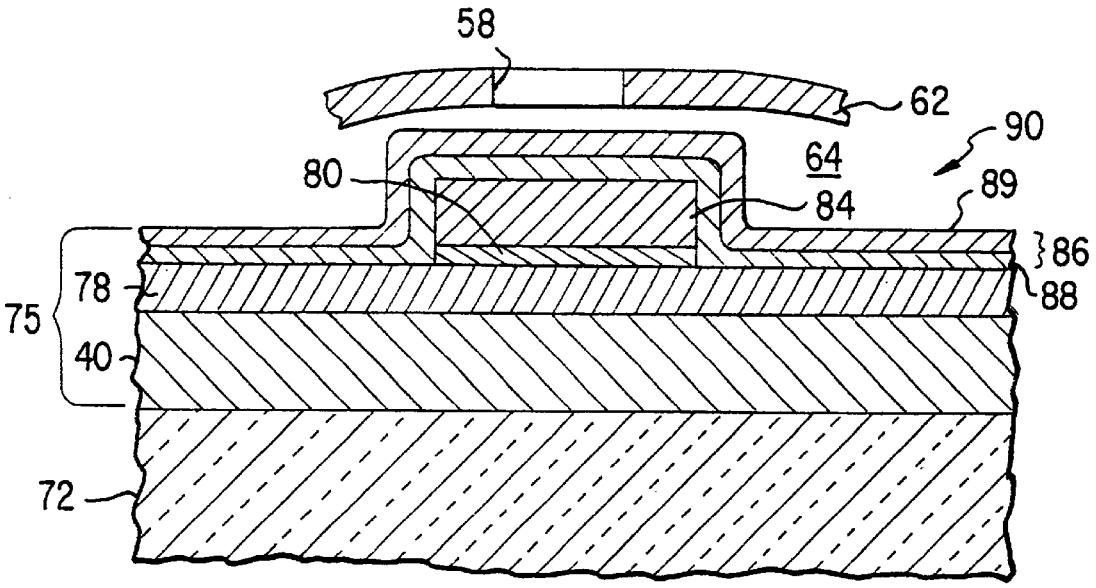
FIG. 9 is a diagrammatic fragmentary cross sectional view taken at the line 5—5 of FIG. 8, and is shown greatly enlarged in comparison to the illustration of FIG. 8.
Figure 10:
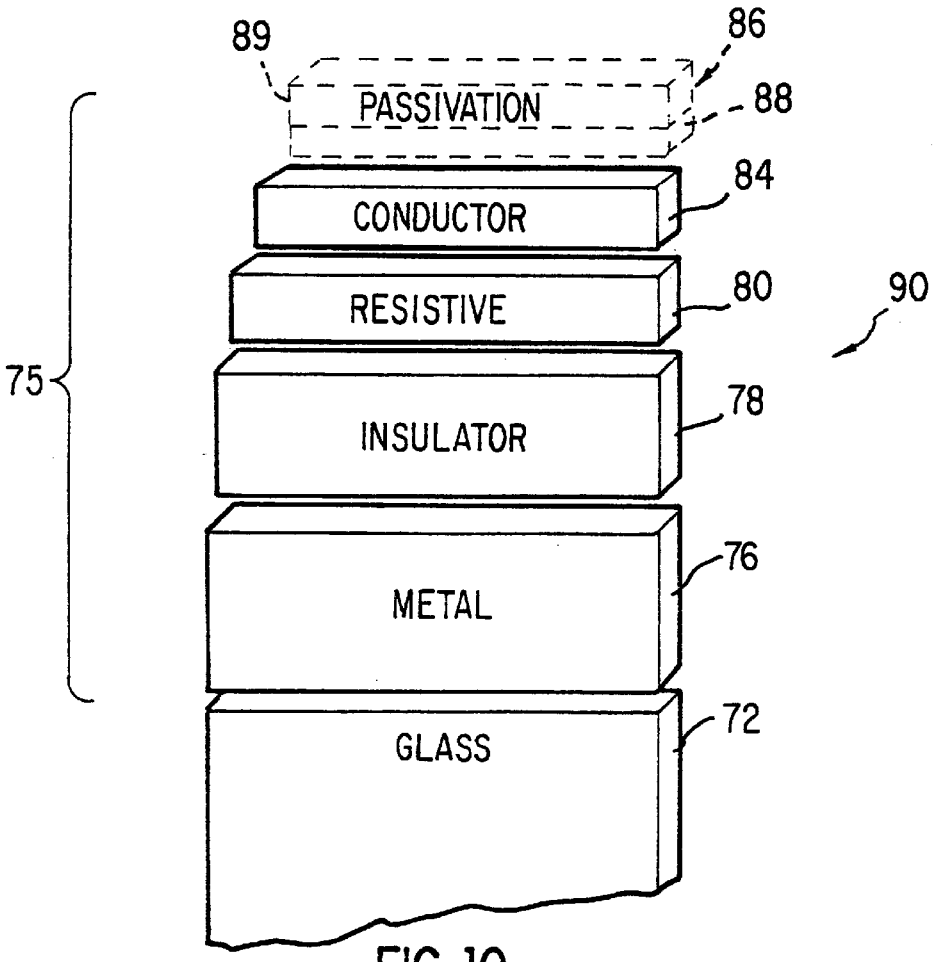
FIG. 10 is a diagrammatic cross sectional view of a portion of the printhead, and during a stage of the manufacturing process, and is similar to the portion seen in FIG. 9.

As FIG. 10 illustrates in fragmentary cross sectional view, a first manufacturing intermediate article 90 results from the above described manufacturing steps prior to the patterning and etching steps described above and prior to the formation of the through hole 66. This first manufacturing intermediate article 90 includes the substrate 72, and the thin-film layers 76, 78, 80, and 84, each of which substantially covers and is congruent with the entire plan-view shape of the substrate 72. The first manufacturing intermediate article 90 is subjected to the patterning and etching processes described above to produce a second manufacturing intermediate article 92, substantially as is seen in FIGS. 4 and 5. On the second manufacturing intermediate article 92 is formed a pair of passivating thin-film layers 86 (FIG. 9) and which is indicated on FIG.6 in dash line. This passivating thin-film layer 86 includes a first sub-layer 88 of silicon nitride, followed by a second substrate layer 89 of silicon carbide. As seen in FIG. 9 fragmentarily, the completion of the printhead 47 requires only the adhesive attachment of the metallic plate member 44, with the print orifices 58 in alignment with the print resistors 82.

In view of the foregoing, those ordinarily skilled in the pertinent arts will understand that the thin-film structure 74 may be formed on the substrate 72 using a variety of techniques. In summary then, during one or more of the deposition processes, the work-piece that will become the first and second intermediate articles, and which will become the completed printhead 47, may be subjected to radio frequency energy. Particularly during the formation of the passivating layers 88 and 89, the second manufacturing intermediate article 92 is exposed to elevated temperatures and to radio frequency energy to assist in the deposition of the layers. During the exposure of the article 92 to radio frequency energy at elevated temperature, the metallic heat sink layer 76 serves as a diffusion barrier to prevent migration of sodium from the soda/lime glass substrate 72 into the other thin layer structures of the printhead 47. Particularly, where the sodium is not prevented from migrating into the passivation layer 88, the sodium could cause a lesion in the passivation layer at which this layer would not long withstand the cavitation occurring in the printing fluid each time a bubble collapse after an ink jet droplet ejection. However, because the heat sink layer 76 covers the entire plan-view shape of the printhead 47, there is no place where sodium from the glass substrate 72 can migrate into the thin-film structures above the metallic heat sink layer 76. Thus, contamination of the thin film structure 74 with sodium from the glass substrate 72 is prevented.

Figure 3:
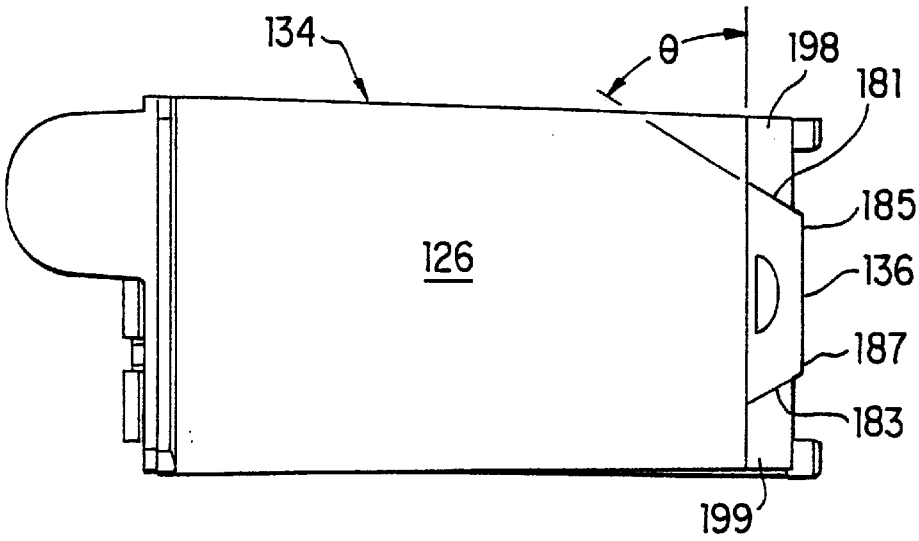
FIG. 3 is another exemplary disposable print cartridge having an integrated inkjet printhead and printhead wiper station which may be used in the printing device of FIG. 1.

Referring now to FIG. 3, there is illustrated another printhead cartridge 126, which is constructed in accordance with the present invention. The printhead cartridge 126 is substantially identical to printhead cartridge 26 except for the structure of the front face portion. In this regard, the printhead cartridge 126 includes a cartridge body 134 that is integrally connected to a raised front face portion 136. The raised front face portion 136 is substantially identical to the front face portion 36 except for its sidewall-outside plateau interconnection. In this regard, the front face portion 136 includes a pair of sidewalls 181 and 183 respectively that extend upwardly from plateaus 198 and 199 respectively at an angle θ, where the angle θ is about 60 degrees. Each one of the sidewalls 181 and 183 terminate in a lip, such as a lip 185 and a lip 187 respectively. From the foregoing, it should be understood by those skilled in the art, that the wedge shaped sidewalls 181 and 183 commence engaging a tip portion of the wiper 40 first and then gradually engage the respective ones of the first cleaning surface and the second cleaning surface providing more of scraping action against such cleaning surfaces.

While particular embodiments of the present invention have been disclosed, it is to be understood that various different modifications are possible and are contemplated within the true spirit and scope of the appended claims. There is no intention, therefore, of limitations to the exact abstract or disclosure herein presented. In this regard, those skilled in the art will further appreciate that the present invention may be embodied in other specific forms without departing from the spirit or central attributes thereof. Because the foregoing description of the present invention discloses only particularly a preferred exemplary embodiment of the invention, it is to be understood that other variations are recognized as being within the scope of the present invention. For example, although the glass substrate of the present invention was describes as having a rectangular shape in plan-view, it is contemplated that other plan-view shapes could be formed to carry out the invention as well. Accordingly, the present invention is not limited to the particular embodiment that has been described in detail herein. Rather, reference should be made to the appended claims to define the spirit and scope of the present invention.

We claim:

1. A method of cleaning an inkjet printhead cartridge having a printhead, comprising:

providing a wiper cleaning station integrally formed on the printhead cartridge;

providing said wiper cleaning station with a pair of recessed wiper debris collectors, each having a generally rectangular box like shape, wherein each individual recessed debris collector opens into a corresponding debris accumulation channel;

engaging the printhead with a stationary wiper mounted within a printing device; and accumulating removed wiper debris within the debris accumulation channels.

2. A method of cleaning according to claim 1, wherein said step of engaging includes:

removing wiper debris from said wiper; and removing printhead debris immediately after said wiper debris has been removed from said wiper.

3. A method of cleaning according to claim 2, wherein said printing device includes a base and a stall coupled to the base for supporting therein the printhead cartridge, said printhead cartridge having a width dimension; and wherein said step of removing wiper debris from said wiper includes:

moving the stall to transport said wiper service station along a path of travel substantially less in length than said width dimension of the printhead cartridge;

contacting the integrally formed wiper service station with said wiper as the service station travels along the path of travel in a first direction;

disengaging the wiper from the wiper service station by continuing the travel of the service station in the first direction to bring the wiper over a linear translation reversing space defined by an external sidewall of the wiper service station and a front wall of the printhead cartridge; and reversing the direction of movement of the stall to again contact the wiper service station as the service station travels along the path of travel in a second direction, wherein the linear translation reversing space permits the wiper to disengage from said wiper service station when said printhead cartridge is opposite said wiper to reduce wiper wear as said printhead cartridge reverses its traveling direction along said path of travel.

4. The method of claim 3, further comprising:

disengaging the wiper from the wiper service station by continuing the travel of the service station in the second direction to bring the wiper over another linear translation reversing space defined by a second external sidewall of the wiper service station and the front wall of the printhead cartridge.

5. The method of claim 4, wherein the printhead further includes a printhead nozzle array disposed adjacent the wiper service station, and wherein the step of engaging the printhead includes:

contacting said printhead nozzle array with said wiper to wipe the nozzle array as the service station travels along the path of travel in said first direction and in said second direction.

6. A method of cleaning according to claim 2, wherein said step of providing said wiper cleaning station further includes:

providing dams in each debris accumulation channel to facilitate directing fluid communication with printhead debris into said debris collectors.

7. A method of cleaning according to claim 6, further comprising:

providing a printhead cartridge stall within the printing device, said stall being mounted for rectilinear movement along a path of travel and being dimensioned to support from below the printhead cartridge.

8. A method of cleaning according to claim 2, wherein the step of providing a wiper cleaning station includes:

providing a first linear translation reversing space adjacent a first one of said debris accumulation channels, said first space defined by a first external sidewall of said wiper service station and a front wall of the printhead cartridge, and a second linear translation reversing space adjacent a second one of said debris accumulation channels, said second space defined by a second external sidewall of said wiper service station and the front wall of the printhead cartridge for permitting the wiper to disengage from said wiper service station when said first or second linear traversing space of the printhead cartridge is opposite said wiper.

9. A method of cleaning according to claim 8, wherein the printhead is disposed between said corresponding debris accumulation channel of a first one of said pair of wiper debris collectors and said corresponding debris accumulation channel of a second one of said pair of wiper debris collectors, and includes a nozzle array positioned to engage said wiper to clean the nozzle array as the printhead cartridge travels along the path of travel.

10. A method of cleaning according to claim 2, wherein said stall is dimensioned to support the printhead cartridge to facilitate the ejecting of ink onto a transaction receipt having a width dimension of about three inches.

11. A method of cleaning a wiper, comprising:

providing a printhead cartridge having an integrally formed wiper cleaning station disposed between a pair of spaced apart linear translation reversing areas;

holding the wiper constantly in a fixed stationary position within a rectlinear path of travel followed by said printhead cartridge;

moving the printhead cartridge along said rectlinear path to a wiper cleaning position to facilitate removal of wiper debris by said wiper cleaning station;

moving said printhead cartridge along said rectlinear path to a printhead cleaning position to facilitate removal of printhead debris by the wiper; and moving the printhead cartridge along said rectlinear path to one of said pair of linear translation reversing areas to disengage the wiper from the printhead cartridge to facilitate reducing wiper wear as said printhead cartridge reverses its traveling direction along said rectilinear path of travel.

12. A method of cleaning according to claim 11, wherein said step of moving the printhead cartridge to a printhead cleaning position includes:

removing the printhead debris immediately after said wiper debris has been removed from said wiper.

13. A method of cleaning an inkjet printhead wiper, comprising:

providing a printhead cartridge having an integrally formed wiper cleaning station disposed between a pair of linear translation reversing spaces;

said pair of linear translation reversing spaces each being defined by an external sidewall of said wiper cleaning station and a front wall of the printhead cartridge;

moving the printhead cartridge repeatedly along a rectlinear path of travel having a length substantially less than the width dimension of said printhead cartridge and extending between said pair of linear translation reversing spaces to cause said wiper to repeatedly engage said wiper cleaning station and to repeatedly disengage said wiper cleaning station for removing wiper debris from said wiper and without creating any substantial wiper wear as said printhead cartridge reverses direction along said rectlinear path of travel.

* * * * *